United States Patent [19]

Wulff

[11] Patent Number: 4,841,266

[45] Date of Patent: Jun. 20, 1989

[54] CIRCUIT BREAKER HAVING AN ELECTRODYNAMICALLY OPENING CONTACT SYSTEM

[75] Inventor: Hans-Jürgen Wulff, Hohenwestedt, Fed. Rep. of Germany

[73] Assignee: Licentia Patent-Verwaltungs-GmbH, Frankfurt am Main, Fed. Rep. of Germany

[21] Appl. No.: 172,932

[22] Filed: Mar. 18, 1988

[30] Foreign Application Priority Data

Mar. 18, 1987 [DE] Fed. Rep. of Germany ..... 3708807

[51] Int. Cl.[4] ..... H01H 75/00

[52] U.S. Cl. ..... 335/16; 335/147; 335/195

[58] Field of Search ..... 335/6, 16, 147, 195; 200/147 R

[56] References Cited

U.S. PATENT DOCUMENTS 4,219,790 8/1980 Batteux et al. ..... 335/16
4,540,961 9/1983 Maier ..... 335/16
4,562,419 12/1985 Preuss et al. .

FOREIGN PATENT DOCUMENTS 0148111 12/1984 European Pat. Off. .
1079176 4/1960 Fed. Rep. of Germany .
2128633 1/1973 Fed. Rep. of Germany .
2838630 3/1979 Fed. Rep. of Germany .
2940692 4/1980 Fed. Rep. of Germany .
1564412 4/1980 United Kingdom .

*Primary Examiner*—E. A. Goldberg
*Assistant Examiner*—Lincoln Donovan
*Attorney, Agent, or Firm*—Spencer & Frank

[57] ABSTRACT

A circuit breaker comprises a housing; a stationary contact mounted in the housing; an operating shaft disposed in the housing and rotatable about a first axis of rotation; and a movable contact including a contact arm pivotally held in the operating shaft for rotation about a second axis of rotation from an on position into a tripped position. By rotating the operating shaft about the first axis of rotation, the contact arm is movable into and out of the on position and an off position. The contact arm further has a terminus including a rounded corner and an adjoining rounded engagement face. There is further provided a structural unit stationarily supported in the housing and comprising a spring having a stationarily supported first end and a second end and a transfer lever having an end pivotally supported for rotation about a third axis of rotation. The lever is disposed between the second end of the spring and the terminus of the contact arm and engages the rounded corner or the rounded engagement face dependent on the position of the contact arm for transmitting a torque from the spring to the contact arm about the second rotary axis.

6 Claims, 1 Drawing Sheet

CIRCUIT BREAKER HAVING AN ELECTRODYNAMICALLY OPENING CONTACT SYSTEM

BACKGROUND OF THE INVENTION

1. Field of the Invention

The present invention relates to a circuit breaker having an electrodynamically opening contact system for limiting current. The contact system has a fixed contact element and a contact arm (forming a movable contact element) movable into an off and on position by an operating shaft. There is further provided a spring which acts upon the contact arm through the intermediary of a force-transmitting lever. Further, the contact arm has a tripped position into which it is moved from the on position by an overloadresponsive device when the current flow through the circuit breaker is of excessive intensity.

2. Discussion of the Prior Art

Switches having electrodynamically opening contact systems are generally known in the prior art. In German Patent No. 1,079,176 two parallel mounted tension springs are arranged between a pin disposed transversely through the movable contact element and a fixed point in the vicinity of the fulcrum. In the closed contact position the two springs have a force component which generates a contact force on the movable contact element. As soon as the movable contact element opens in response to an electrodynamic force, the direction of the contact force is reversed.

Similar solutions are disclosed in British Patent No. 1,564,412 and U.S. Pat. No. 4,540,961. However, in U.S. Pat. No. 4,540,961 there is no displacement of the force component in the hold-open position; rather, this is effected by friction. European Patent No. 148,111 to which corresponds U.S. Pat. No. 4,562,419, discloses a tension or compression spring arrangement which has a displaceable point of engagement between limits of a slide guide.

In these prior art spring arrangements, the spring is either disposed very close to the fulcrum of the movable contact element or it is disposed at a more remote location. If the spring is disposed close to the fulcrum it must generate very great forces relative to the contact pressure. If the spring is disposed at a more remote location it must be able to function with very large pivot paths or deformations. For multi-pole circuit breakers, in which the movable contact elements are mounted in a common operating shaft, the stationary attachment point of the spring must also be located in the operating shaft.

SUMMARY OF THE INVENTION

It is an object of the present invention to provide an improved circuit breaker of the above-outlined type in which the forces of the spring have a supporting effect in every position of the switch.

The above and other objects are accomplished by the invention in which the circuit breaker comprises a housing; a fixed contact element mounted in the housing; a movable contact element pivotally mounted in the housing and having an end with a rounded portion and a rounded corner; an operating shaft for moving the movable contact element into the on and off position; and a movable contact element biasing means for biasing the end of the movable contact element. The biasing means has an end stationarily mounted to the housing.

The biasing means includes a transfer lever having first and second portions, wherein the first portion operatively contacts the end of the movable contact element; a spring operatively connected to the transfer lever for biasing the transfer lever against the end of the movable contact element. The transfer lever is pivotally supported at its second portion.

With the arrangement and configuration of the transfer (force-transmitting) lever and the end portion of the movable contact arm, particular advantages result. When electrodynamic forces occur, the movable contact element is able to move freely until it reaches its stop. After a predetermined opening path, the force component acting on the movable contact arm is reversed in direction, so that it applies a force in the "hold-open" direction of the movable contact arm. Moreover, the spring which produces the contact pressure may be arranged so that one end is stationarily mounted in the circuit breaker even if the movable contact arm is mounted in a common operating shaft. This causes forces to act on the operating shaft which accelerate its switch-off movement when the switch is tripped. This advantage is of particular significance if the dynamic forces have not yet opened the movable contact arm to the point where reversal of the torque has occurred.

The spring and the transfer lever may be pre-assembled as a unit and may be inserted before the contact system is installed in the switch housing. It is a further advantage of the construction according to the invention that the contact pressure on the contact arm is substantially independent of the amount of consumption of the contacts.

DESCRIPTION OF THE PREFERRED EMBODIMENT

Figure 1:
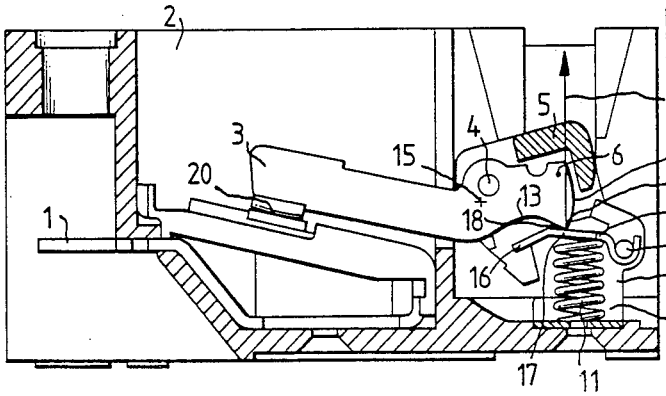
FIG. 1 is a side elevational view of a circuit breaker according to a preferred embodiment of the invention shown in the on position.
Figure 2:
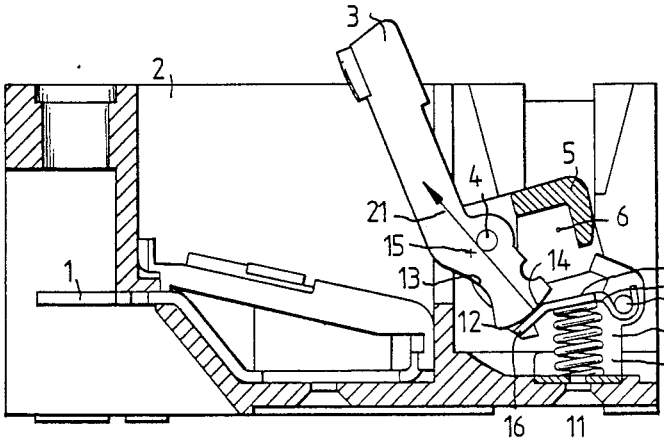
FIG. 2 is a side elevational view of the preferred embodiment shown in the tripped position.
Figure 3:
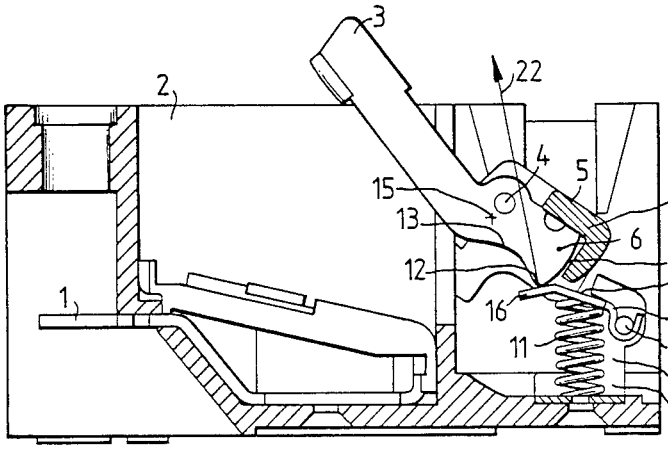
FIG. 3 is a side elevational view of the preferred embodiment shown in the off position.

The contact system shown in FIGS. 1 to 3 is composed of a U-shaped fixed contact element 1 fastened in a chamber of a housing 2 and a movable contact element (contact arm) 3 pivotally mounted on a pivot pin 4 held in an operating shaft 5. The operating shaft 5 is rotatable about the rotary axis 6 and is turnable by a drive mechanism (not shown) from the off position shown in FIG. 3 to the on position shown in FIG. 1. A biasing means 7 is provided to generate a contact pressure on movable contact element 3. The biasing means 7 is composed of a compression spring 11, a spring holder 8 fastened in the housing 2 and a transfer lever 10 mounted so as to be pivotal about a pin 9 supported by the spring holder 8. It is to be understood that instead of a compression spring a tension spring or torsion spring may be used. The end portion of movable contact element 3 adjacent the operating shaft 5 has a specially shaped outline configuration which includes a distinct corner 12 which has a small radius of curvature and one side of which adjoins a circular arc-shaped rounded portion 14 whose center 15 lies below the axis of rotation of the movable contact element 3, that is, between such axis of rotation and the arcuate rounded portion 14. A recessed portion 13 is situated on the other side of the rounded corner 12. The free end of transfer lever 10 is provided with an angled portion or tab 16. Between the pivot pin 9 and tab 16 the transfer lever 10 has a central, planar contact face 17. When in the on position, the pin 9 of transfer lever 10, the pin 4 of the movable contact element 3 and the contact point 18 between movable contact element 3 and transfer lever 10 all lie approximately in a single line. The present invention will perform as intended due to the above-described configuration of the transfer lever 10 and the end portion of movable contact element 3 as well as the arrangement of pivot pins 4 and 9 and contact point 18.

In the on position of the switch shown in FIG. 1, compression spring 11 generates a force through contact face 17 of transfer lever 10 on the rounded corner 12 of the movable contact element 3. This force acts in the direction of arrow 19 and thus generates a contact pressure between the fixed contact element 1 and the movable contact element 3 at contact point 20. When the contact pieces of the contact elements 1, 3 have burnt down, transfer lever 10 follows the self-adjusting motions of the movable contact element 3. This causes the spring 11 to expand, resulting in a reduction of the spring force. Such a decreased spring force is substantially compensated by an increase of the force component in the direction of arrow 19 so that a contact pressure results which is essentially uninfluenced by the consumption of the contacts. Recess 13 is so designed that the tab 16 of the transfer lever 10 cannot make contact with that zone of the movable contact element 3.

If in the on position of the circuit breaker, electrodynamic forces act on the movable contact element 3 because of an excessively high current, the movable contact element 3 can unimpededly move from the on position shown in FIG. 1 to the tripped open position shown in FIG. 2. During this motion the contact point 18 shifts from the rounded corner 12 to the rounded portion 14 of the movable contact element 3 and from the contact face 17 to tab 16 of transfer lever 10. At the same time, the force component of the biasing means 7 acting on movable contact element 3 is displaced in the direction of arrow 21 (FIG. 2), and this produces a torque on movable contact element 3 in the opening direction, and also applies a relatively high torque on the operating shaft 5 about its axis of rotation 6 in the opening direction. Since the switch lock is unlocked simultaneously with the dynamic opening of the movable contact element 3 by way of a releasing mechanism (not shown), the opening speed is increased and a reclosing of the circuit breaker due to a possible rebound of the contact element 3 is prevented.

In the off position of the circuit breaker shown in FIG. 3, transfer lever 10 follows movable contact element 3. In this position, tab 16 lies against rounded corner 12 thereby producing a force component in the direction of arrow 22 that extends between the two pivot pins 4 and 9. This force component 22 generates a torque on the movable contact element 3 and turns the latter against a stop 23 in the operating shaft 5. This generates a torque on the operating shaft 5 about its axis of rotation 6 in the opening direction, thus supporting the operating shaft 5 for maintaining the circuit breaker in its off position.

The present disclosure relates to the subject matter disclosed in Federal Republic of Germany Application No. P 37 08 807.6 (filed Mar. 18th, 1987), the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A circuit breaker comprising (a) a housing;

(b) a stationary contact mounted in the housing;

(c) an operating shaft disposed in the housing and rotatable about a first axis of rotation;

(d) a movable contact including a contact arm pivotally held in said operating shaft for rotation about a second axis of rotation relative to said operating shaft from an on position in which said stationary and movable contacts are in engagement, into a tripped position in which said contacts are separated; said contact arm being movable, by rotation of said operating shaft about said first axis of rotation, into and out of said on position and an off position other than said tripped position; said contact arm further having a terminus including a rounded corner and an adjoining rounded engagement face;

(e) a structural unit stationarily supported in said housing and comprising a spring having a stationarily supported first end and a second end and a transfer lever having an end pivotally supported for rotation about a third axis of rotation; said lever being disposed between said second end of said spring and said terminus of said contact arm and engaging said rounded corner or said rounded engagement face of said terminus dependent on the position of said contact arm for transmitting a torque from said spring to said contact arm about said second rotary axis said transfer lever having a first engagement portion adjoining said third rotary axis and a second engagement portion bent from said first engagement portion in a direction towards said spring.

2. A circuit breaker as defined in claim 1, wherein a relative position between said contact arm and said transfer lever is such that in said on position said first engagement portion of said transfer lever being pressed by said spring against said rounded corner of the terminus of said contact arm for causing said torque to urge said contact arm in a direction towards the on position.

3. A circuit breaker as defined in claim 1, wherein a relative position between said contact arm and said transfer lever is such that in said tripped position said second engagement portion of said transfer lever being pressed by said spring against said rounded engagement face of the terminus of said contact arm for causing said torque to urge said contact arm in a direction away from the on position.

4. A circuit breaker as defined in claim 1, wherein said operating shaft and said terminus of said contact arm have cooperating abutments being out of contact with one another in said on and tripped positions; further wherein a relative position between said contact arm and said transfer lever is such that in said off position said second engagement portion of said transfer lever being pressed by said spring against said rounded corner of the terminus of said contact arm for causing said torque to press said contact arm into engagement with said operating shaft at said abutments for causing said torque to urge said operating shaft in a direction towards said off position about said first rotary axis.

5. A circuit breaker as defined in claim 1, wherein said rounded engagement face has a radius of curvature whose center lies between said second rotary axis and said rounded engagement face immediately adjacent said second rotary axis.

6. A circuit breaker as defined in claim 1, wherein said spring is a compression spring.

* * * * *